US008978324B2

(12) United States Patent
Collins et al.

(10) Patent No.: US 8,978,324 B2
(45) Date of Patent: Mar. 17, 2015

(54) PRE-MANUFACTURED UTILITY WALL

(71) Applicant: Innovative Building Technologies, LLC, Seattle, WA (US)

(72) Inventors: Arlan Collins, Seattle, WA (US); Mark Woerman, Seattle, WA (US)

(73) Assignee: Innovative Building Technologies, LLC, Seattle, WA (US)

( * ) Notice: Subject to any disclaimer, the term of this patent is extended or adjusted under 35 U.S.C. 154(b) by 0 days.

(21) Appl. No.: 14/077,565

(22) Filed: Nov. 12, 2013

(65) Prior Publication Data

US 2014/0069035 A1 Mar. 13, 2014

Related U.S. Application Data

(63) Continuation of application No. 13/155,319, filed on Jun. 7, 2011, now abandoned, which is a continuation-in-part of application No. 12/796,625, filed on Jun. 8, 2010, and a continuation-in-part of application No. 12/796,603, filed on Jun. 8, 2010.

(51) Int. Cl.
*E04C 2/52* (2006.01)
*E04B 2/72* (2006.01)

(52) U.S. Cl.
CPC .. *E04C 2/521* (2013.01); *E04B 2/72* (2013.01)
USPC ..... 52/220.1; 52/404

(58) Field of Classification Search
CPC ..... E04B 1/34869; E04C 2/384; E04C 2/52; E04C 2/521; E04C 2/38
USPC ..... 52/143, 79.2, 220.1, 220.31, 407.3, 404
See application file for complete search history.

(56) References Cited

U.S. PATENT DOCUMENTS

| | | | |
|---|---|---|---|
| 1,883,376 | A | 10/1932 | Meier et al. |
| 2,419,319 | A | 4/1947 | Lankton |
| 2,562,050 | A | 7/1951 | Lankton |
| 2,686,420 | A | 8/1954 | Youtz |
| 2,871,544 | A | 2/1959 | Youtz |
| 3,017,723 | A | 1/1962 | Von Heidenstam |
| 3,052,449 | A | 9/1962 | Long et al. |
| 3,053,015 | A | 9/1962 | Graham |
| 3,221,454 | A | 12/1965 | Togni |

(Continued)

FOREIGN PATENT DOCUMENTS

| | | |
|---|---|---|
| AU | 2005200682 B1 | 5/2005 |
| CN | 20137279 | 3/2008 |

(Continued)

OTHER PUBLICATIONS

Riusillo, M.A., "Lift Slab Construction: its History, Methodology, Economics and Applications." ACI-Abstract, Jun. 1, 1988.

(Continued)

*Primary Examiner* — Brian Glessner
*Assistant Examiner* — Paola Agudelo
(74) *Attorney, Agent, or Firm* — Dorsey & Whitney LLP

(57) ABSTRACT

The present invention relates to pre-manufactured utility walls that may be readily adapted for use in multi-story building construction. The present invention efficiently and conveniently consolidates utility components typically found in residential, institutional and/or commercial settings into a pre-manufactured, preassembled and, optionally, pre-bundled component at a site other than the building site.

19 Claims, 16 Drawing Sheets

(56) References Cited

U.S. PATENT DOCUMENTS 3,245,183 A 4/1966 Tessin
3,388,512 A 6/1968 Newman
3,490,191 A 1/1970 Ekblom
3,579,935 A 5/1971 Regan et al.
3,590,393 A 7/1971 Hollander
3,594,965 A 7/1971 Saether
3,604,174 A 9/1971 Nelson, Jr.
3,638,380 A 2/1972 Perri
3,707,165 A 12/1972 Stahl
3,713,265 A 1/1973 Wysocki et al.
3,721,056 A 3/1973 Toan
3,722,169 A 3/1973 Boehmig
3,727,753 A 4/1973 Starr
3,742,666 A 7/1973 Antoniou
3,755,974 A 9/1973 Berman
3,762,115 A 10/1973 McCaul, III
3,766,574 A 10/1973 Smid, Jr.
3,821,818 A 7/1974 Alosi
3,853,452 A 12/1974 Delmonte
3,906,686 A * 9/1975 Dillon ..... 52/79.9
3,921,362 A 11/1975 Ortega
3,926,486 A 12/1975 Sasnett
3,971,605 A 7/1976 Sasnett
3,974,618 A 8/1976 Cortina
4,050,215 A 9/1977 Fisher
4,078,345 A 3/1978 Piazzalunga
4,107,886 A 8/1978 Ray
4,142,255 A 3/1979 Togni
4,171,545 A 10/1979 Kann
4,178,343 A 12/1979 Rojo, Jr.
4,221,441 A 9/1980 Bain
4,226,061 A 10/1980 Day, Jr.
4,280,307 A 7/1981 Griffin
4,314,430 A 2/1982 Farrington
4,325,205 A 4/1982 Salim
4,327,529 A 5/1982 Bigelow, Jr.
4,341,052 A 7/1982 Douglass, Jr.
4,435,927 A 3/1984 Umezu et al.
4,441,286 A 4/1984 Skvaril
4,447,996 A 5/1984 Maurer, Jr.
4,477,934 A 10/1984 Salminen
4,507,901 A 4/1985 Carroll
4,513,545 A 4/1985 Hopkins, Jr.
4,528,793 A 7/1985 Johnson
4,646,495 A 3/1987 Chalik
4,655,011 A 4/1987 Borges
4,856,244 A 8/1989 Clapp
4,919,164 A * 4/1990 Barenburg ..... 137/15.08
5,076,310 A * 12/1991 Barenburg ..... 137/15.08
5,205,091 A 4/1993 Brown
5,307,600 A 5/1994 Simon, Jr.
5,359,820 A 11/1994 McKay
5,402,612 A 4/1995 diGirolamo et al.
5,412,913 A 5/1995 Daniels et al.
5,459,966 A 10/1995 Suarez
5,471,804 A 12/1995 Winter, IV
5,493,838 A 2/1996 Ross
5,509,242 A 4/1996 Rechsteiner et al.
5,528,877 A 6/1996 Franklin
5,628,158 A 5/1997 Porter
5,660,017 A 8/1997 Houghton
5,678,384 A 10/1997 Maze
5,697,189 A 12/1997 Miller
5,699,643 A 12/1997 Kinard
5,724,773 A 3/1998 Hall
5,755,982 A 5/1998 Strickland
5,850,686 A 12/1998 Mertes
5,867,964 A 2/1999 Perrin
5,870,867 A 2/1999 Mitchell
5,987,841 A * 11/1999 Campo ..... 52/648.1
5,997,792 A 12/1999 Gordon
6,000,194 A 12/1999 Nakamura
6,073,401 A 6/2000 Iri et al.
6,076,319 A 6/2000 Hendershot
6,086,350 A 7/2000 Del Monte
6,154,774 A 11/2000 Furlong
6,243,993 B1 6/2001 Swensson
6,244,008 B1 6/2001 Miller
6,260,329 B1 7/2001 Mills
6,301,838 B1 * 10/2001 Hall ..... 52/34
6,308,465 B1 * 10/2001 Galloway et al. ..... 52/79.1
6,308,491 B1 10/2001 Porter
6,393,774 B1 5/2002 Fisher
6,481,172 B1 11/2002 Porter
6,484,460 B2 11/2002 VanHaitsma
6,625,937 B1 9/2003 Parker et al.
6,651,393 B2 11/2003 Don et al.
6,837,013 B2 1/2005 Foderberg et al.
6,922,960 B2 8/2005 Sataka
7,143,555 B2 12/2006 Miller
7,389,620 B1 6/2008 McManus
7,395,999 B2 7/2008 Walpole
7,444,793 B2 11/2008 Raftery et al.
7,467,469 B2 12/2008 Wall
7,484,339 B2 2/2009 Fiehler
7,676,998 B2 3/2010 Lessard
7,694,462 B2 4/2010 O'Callaghan
7,721,491 B2 5/2010 Appel
7,748,193 B2 7/2010 Knigge et al.
7,908,810 B2 3/2011 Payne, Jr. et al.
7,921,965 B1 4/2011 Surace
8,109,058 B2 2/2012 Miller
8,234,833 B2 8/2012 Miller
8,251,175 B1 8/2012 Englert et al.
8,322,086 B2 12/2012 Weber
8,359,808 B2 1/2013 Stephens, Jr.
8,424,251 B2 4/2013 Tinianov
8,539,732 B2 9/2013 Leahy
8,555,581 B2 10/2013 Amend
8,621,806 B2 1/2014 Studebaker et al.
8,769,891 B2 7/2014 Kelly
2002/0059763 A1 5/2002 Wong
2002/0170243 A1 11/2002 Don et al.
2003/0005653 A1 1/2003 Sataka
2003/0101680 A1 6/2003 Lee
2003/0140571 A1 7/2003 Muha et al.
2003/0167712 A1 9/2003 Robertson
2004/0103596 A1 6/2004 Don
2005/0081484 A1 4/2005 Yland
2005/0108957 A1 5/2005 Quesada
2005/0188632 A1 * 9/2005 Rosen ..... 52/220.2
2005/0198919 A1 9/2005 Hester, Jr.
2005/0210764 A1 * 9/2005 Foucher et al. ..... 52/79.5
2005/0235581 A1 10/2005 Cohen
2006/0021289 A1 2/2006 Elmer
2006/0096202 A1 5/2006 DelZotto
2006/0117689 A1 6/2006 Onken et al.
2006/0179764 A1 * 8/2006 Ito ..... 52/506.06
2006/0248825 A1 11/2006 Garringer
2007/0074464 A1 4/2007 Eldridge
2007/0107349 A1 5/2007 Erker
2007/0163197 A1 7/2007 Payne et al.
2007/0209306 A1 * 9/2007 Andrews et al. ..... 52/317
2007/0294954 A1 12/2007 Barrett
2008/0057290 A1 3/2008 Guevara et al.
2008/0104901 A1 5/2008 Olvera
2008/0168741 A1 7/2008 Gilgan
2008/0178542 A1 * 7/2008 Williams ..... 52/220.7
2008/0282626 A1 11/2008 Powers, Jr.
2008/0295450 A1 12/2008 Yogev
2009/0100769 A1 4/2009 Barrett
2009/0113820 A1 * 5/2009 Deans ..... 52/169.14
2009/0134287 A1 5/2009 Klosowski
2009/0165399 A1 7/2009 Campos
2009/0205277 A1 8/2009 Gibson
2009/0293395 A1 12/2009 Porter
2010/0064601 A1 3/2010 Napier
2010/0186313 A1 7/2010 Stanford et al.
2010/0229472 A1 * 9/2010 Malpas ..... 52/79.1
2010/0263308 A1 10/2010 Olvera
2010/0325989 A1 12/2010 Leahy
2011/0056147 A1 3/2011 Beaudet
2011/0296778 A1 * 12/2011 Collins et al. ..... 52/220.1
2011/0300386 A1 12/2011 Pardue, Jr.

(56) References Cited

U.S. PATENT DOCUMENTS

| | | | |
|---|---|---|---|
| 2012/0151869 | A1 | 6/2012 | Miller |
| 2013/0133277 | A1 | 5/2013 | Lewis |
| 2014/0013695 | A1 | 1/2014 | Wolynski et al. |
| 2014/0047780 | A1 | 2/2014 | Quinn et al. |
| 2014/0059960 | A1 | 3/2014 | Cole |
| 2014/0069035 | A1 | 3/2014 | Collins et al. |
| 2014/0083046 | A1 | 3/2014 | Yang |
| 2014/0130441 | A1 | 5/2014 | Sugihara et al. |

FOREIGN PATENT DOCUMENTS

| | | | |
|---|---|---|---|
| EP | 1045078 | | 10/2000 |
| EP | 1739246 | B1 | 1/2011 |
| EP | 2281964 | A1 | 2/2011 |
| JP | H0130985 | A | 1/1991 |
| JP | 10234493 | | 9/1998 |
| JP | 2000144997 | A2 | 5/2000 |
| JP | 2008073434 | | 4/2008 |
| JP | 2008110104 | | 5/2008 |
| KR | 20060066931 | B1 | 6/2006 |
| WO | WO 97/022770 | | 6/1997 |
| WO | WO 2007/059003 | | 5/2007 |
| WO | WP 2010/030060 | | 3/2010 |

OTHER PUBLICATIONS

International Search Report and Written Opinion of the International Searching Authority for PCT Application No. PCT/US2011/001039 mailed on Oct. 5, 2011.

"Beam to column connection", TATA Steel, http://www.tatasteelconstruction.com/en/reference/teaching_resources/architectural_studio_reference/elements/connections/beam_to_column_connections, Jul. 9, 2014, pp. 1-4.

"Emerging Trends 2012 Executive Summary", Urban Land Institute, Ch. 1, 2011, pp. 3-13.

"How to Soundproof a Ceiling—Soundproofing Ceilings", http://www.soundproofingcompany.com/soundproofingsolutions/sound-proof-a-ceiling/, Apr. 2, 2014, pp. 1-7.

Borzouie, Jamaledin, et al., "Seismic Assessment and Rehabilitation of Diaphragms—Technical report", http://www.nosazimadares.ir/behsazi/15WCEE2012/Urm/1/Roof.pdf, Dec. 31, 2011, pp. 1-86.

"Structural Insulated Panel", Wikipedia, http://www.en.wikipedia.org//wiki/Structural_insulated_panel, Aug. 15, 2014.

"Structural Insulated Panels", Sip Solutions, http://www.sipsolutions.com/content/structural-insulated-panels, Aug. 15, 2014.

"US Apartment & Condominium Construction Forecast 2003-2017", Jun. 2012, Statista, Inc.

Azari, et al., "Modular Prefabricated Residential Construction—Constraints and Opportunities", Pnccre Technical Report #TR002, Aug. 2013, pp. i-90.

Giles, et al., "Innovations in the Development of Industrially Designed and Manufactured Modular Concepts for Low-Energy, Multi-Story, High Density, Prefabricated Affordable Housing", Innovations in the Development of Industrially Designed and Manufactured Modular Concepts, 1-15.

Gonchar, "Paradigm Shift—Multistory Modular", Architectural Record, Oct. 2012, pp. 144-148.

Kerin, et al., "National Apartment Market Report—2013", Marcus & Millichap, 2013, 1-9.

McIlwain, "Housing in America—the Next Decade", Urban Land Institute, 2010, pp. 1-28.

McIlwain, "The Rental Boost From Green Design", Urban Land, Jan. 4, 2012, pp. 1-3.

Shashaty, Andre, "Housing Demand", Sustainable Communities, Apr. 2011, pp. 14-18.

Sichelman, "Severe Apartment Shortage Looms", Urban Land, http://urbanland.uli.org/capital-markets/nahb-orlando-severe-apartmentshortage-looms/, Jan. 13, 2011, pp. 1-2.

Stiemer, S F., "Bolted Beam-col. Connections", http://faculty.philau.edu/pastorec/Tensile/bolted_beam_column_connections.pdf, Nov. 11, 2007, pp. 1-16.

* cited by examiner

NOTE: DIAGRAM IS ROTATED TO SHOW INTERIOR CONDITION

NOTE: DIAGRAM IS ROTATED TO SHOW INTERIOR CONDITION

NOTE: DIAGRAM IS ROTATED TO SHOW INTERIOR CONDITION

PRE-MANUFACTURED UTILITY WALL

RELATED APPLICATIONS

This application is a continuation of copending U.S. patent application Ser. No. 13/155,319, filed Jun. 7, 2011, which is in turn a continuation-in-part of copending U.S. patent application Ser. No. 12/796,625, filed Jun. 8, 2010, titled "Construction System And Method For Constructing Buildings Using Premanufactured Structures," and also a continuation-in-part of copending U.S. patent application Ser. No. 12/796,603, filed Jun. 8, 2010, titled "Premanufactured Structures For Constructing Buildings." The entirety of each of these applications is incorporated herein by reference.

FIELD OF THE INVENTION

The present invention relates generally to the construction industry, and relates more specifically to pre-manufactured utility walls. The pre-manufactured utility walls of the present invention may be pre-plumbed, pre-wired, prefinished, preassembled, and pre-bundled double stud walls, and may comprise electrical and communications wiring for adjacent walls, an electrical service panel, water heater, kitchen and bath plumbing, fans, support for interior cabinets, and a toilet mounting support with a water-resistant interior surface, a vapor barrier, insulation, plumbing chase, studs for framing, and a water and air barrier with a water resistant exterior surface.

The pre-manufactured utility walls can be specifically adapted for use in construction of multi-story buildings. The pre-manufactured utility walls may be stacked in a vertical fashion so that utility components may be shared between floors of a multi-story building. The pre-manufactured utility walls may also be specifically adapted for use in lift-slab construction. The pre-manufactured utility walls may be designed for space efficiency, easy transport, and rapid installation.

BACKGROUND OF THE INVENTION

Conventional residential, institutional and commercial construction typically involves extension of various utility lines into a unit space so that utilities may be installed and connected during the final phases of building construction. Installation of individual utility components and connection to pertinent main supply and waste resources is typically a time-consuming and costly phase of building construction. The skills of various trades people are typically required, and coordination of the various trades are difficult to organize and construction often proceeds in a piecemeal fashion depending on the work performed by the various trades people.

BRIEF SUMMARY OF THE INVENTION

The inventors have discovered that normal utility components found in a residence, institutional or commercial setting can be efficiently and conveniently consolidated and assembled into a single pre-manufactured component at a site other than the building site. By grouping these normal utility components together in a standardized fashion, the installation of utilities for a given building unit can occur more quickly, in a matter of hours rather than days or weeks and at a reduced cost. In addition to cheaper, faster, and more organized and reliable construction, the pre-manufactured utility walls of the present invention also provide other benefits including, but not limited to, increased consistency and quality of craftsmanship, reduced exposure of the various utility components to undesirable elements due to their fabrication in a controlled environment, more environmentally-sound and socially responsible construction practices, and increased convenience and accessibility to utility components for maintenance.

In a preferred embodiment, the pre-manufactured utility walls of the present invention present are assembled as follows: (a) laying out the bottom and top plates of the wall to a predetermined length based on a standard template; (b) pre-punching the bottom and top plates to correspond with penetrations in the slab per a specified template; (c) manufacturing a non-weight bearing double stud wall with metal studs and fasteners to fit within stud runners located within the pre-punched bottom and top plates of predetermined length; (d) installing reinforcement plates, lifting rods and framing pockets within the non-weight bearing double stud wall to assist moving, hoisting and transportation of the finished wall; (e) installing the water heater or other heating systems and accessories within the cavity area and all supply and waste plumbing to prescribed locations within the non-weight bearing double stud wall; (f) installing all fire protection piping to prescribed locations within the non-weight bearing double stud wall; (g) installing an electric panel, wiring and outlets to prescribed locations within the non-weight bearing double stud wall; (h) attaching blocking at predetermined locations on the interior side of the non-weight bearing double stud wall to act as reinforcing for interior casework and fixtures; (i) installing acoustic blanket insulation within the cavity of interior metal stud wall; (j) installing thermal batt insulation within the cavity of exterior metal stud wall; (k) attaching one layer of exterior sheathing board to the exterior side and one layer of interior sheathing board to the interior side of the non-weight bearing double stud wall; (l) applying a weather resistive barrier to the exterior side of the exterior sheathing board; (m) attaching horizontal furring to the exterior side of the exterior sheathing board; (n) installing rigid insulation between the horizontal furring; (o) attaching vertical furring to the horizontal furring on the exterior side of the exterior sheathing board; (p) installing exterior finished panels and associated flashing components to vertical furring channels; (q) installing the access panel on the exterior side of the non-weight bearing double stud wall; (r) installing interior finish material on the interior sheathing board.

The present invention of a pre-manufactured utility wall may also incorporate the possibility of RF controls, heating and cooling ducting or piping, and gas piping. The present invention may further utilize recycled products and materials and incorporate alternative energy sources and methods of environmental control. The foregoing and other objectives, features, and advantages of the invention will be more readily understood upon consideration of the following detailed description of the invention, taken in conjunction with the accompanying drawings.

The particular materials and methods used to assemble the utility walls of the present invention, and the particular sequence of construction steps disclosed in connection with the utility walls as described in detail herein, are exemplary embodiments of the present invention only and are, in no way, intended to be limiting.

BRIEF DESCRIPTION OF THE DRAWINGS

The accompanying drawings, which are incorporated in and constitute a part of this specification, illustrate various exemplary embodiments.

DETAILED DESCRIPTION OF THE INVENTION

Before describing the invention and the figures, some of the terminology should be clarified. Please note that the terms and phrases may have additional definitions and/or examples throughout the specification. Where otherwise not specifically defined, words, phrases, and acronyms are given their ordinary meaning in the art. Exemplary embodiments may be better understood with reference to the drawings, but these embodiments are not intended to be of a limiting nature.

The utility walls of the present invention may be pre-manufactured and pre-bundled wall with preassembled sections. The utility walls may include kitchen and bath plumbing, a unit's electrical service panel, exhaust vents/fans, HVAC/gas, and any associated electrical and communications distribution wiring for the adjacent walls. The utility wall's plumbing may include the kitchen and bath supply, waste lines and vent ducting. The utility wall may have a finished interior surface and contain pre-installed exhaust vents/fans and vent trims. The utility wall further may include thermal and sound insulation, encapsulate a unit's plumbing chase, and an exterior sheathing and a weather resistive barrier. The utility wall may have a finished exterior surface, and may include fire-rated sheathing and insulation to act as integral air and vapor barrier. Furthermore, the utility wall may include features that allow the stacking and connection of utilities from one building level to the next which permits ready construction of multi-story buildings.

As used herein, "pre-manufactured" refers to construction manufacture that occurs wholly or in part at a location other than the building site.

As used herein, "preassembled" refers to the assembly of the various utility wall components that occurs wholly or in part at a location other than the building site.

As used herein, "pre-bundled" refers to utility wall component(s) that are protected, packaged, secured or otherwise made ready for transportation to the building site.

The kitchen unit of the present invention may be pre-manufactured and preassembled kitchen unit and may include cabinets, preinstalled plumbing, plumbing connections, electrical wiring, vent ducting, countertops, at least one sink, exhaust vents/fans and light fixtures to be installed in the kitchen on the utility walls.

The bathroom vanity of the present invention may include at least one sink and have preinstalled plumbing for installation on, or connection to, the bathroom on the utility walls.

The cabinets of the present invention may be pre-manufactured and preassembled cabinets that may include integral exhaust fans, light fixtures, refrigerator and/or washer and dryer for installation on, or connection to, the utility walls.

Figure 1:
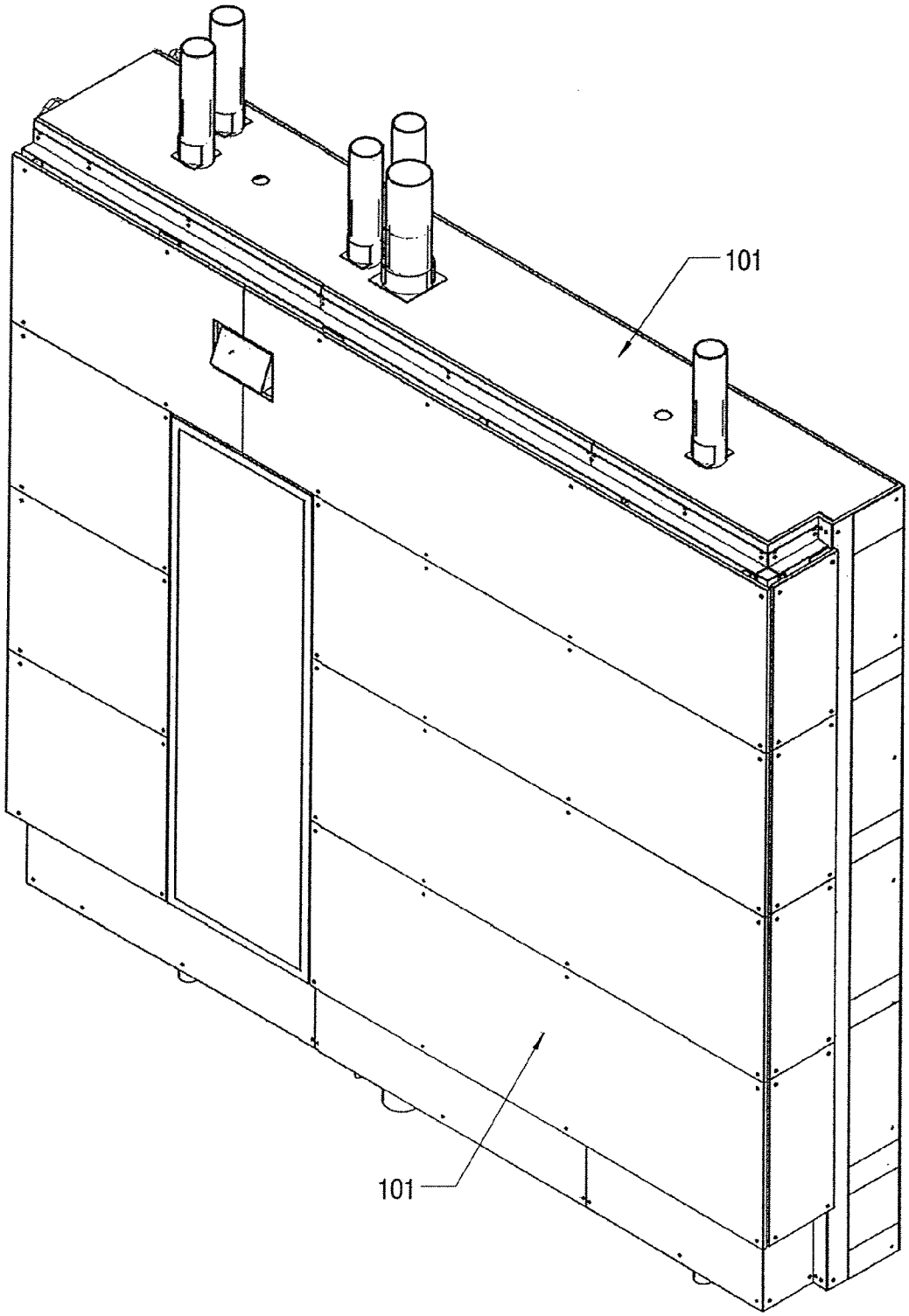
FIG. 1 illustrates a fully completed utility wall.
Figure 2:
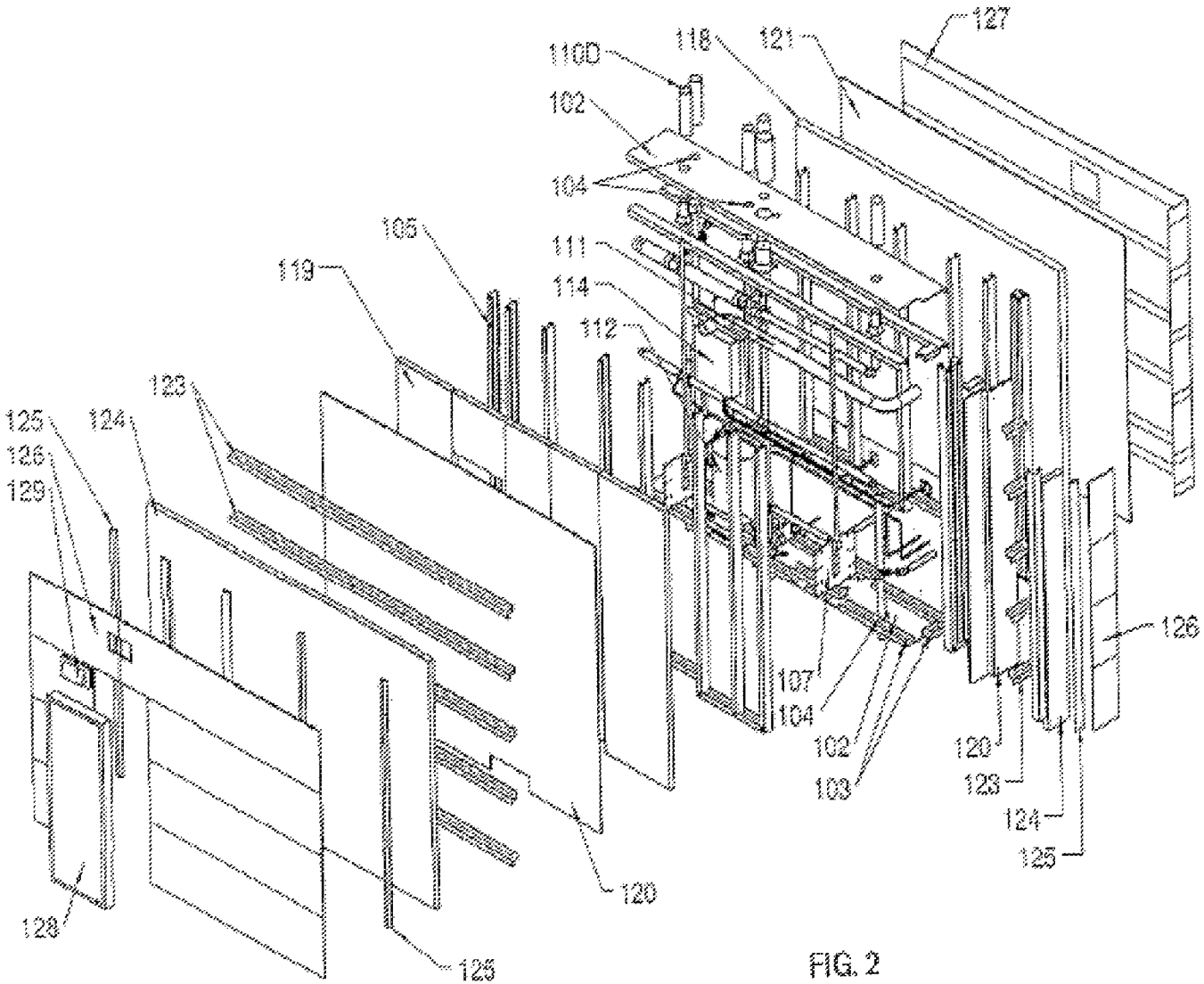
FIG. 2 illustrates in a cut away view of the components that make up the completed utility wall.

Referring in detail to the drawing figures, FIG. 1 illustrates a fully completed utility wall 101. The utility wall 101 may come in various lengths, but the preferred length is ten feet for ease of transporting and installing the utility wall 101. Each unit has a utility wall 101 at the end of every kitchen and bathroom and is comprised of one or more sections of utility wall 101. The utility wall 101 houses common mechanical, plumbing, electrical, and fire protection risers that serve the units. All of the utilities to and from the units may be conveniently accessed at the utility wall 101. FIG. 2 illustrates a cut-away view showing the components that make up the utility wall 101.

Figure 3:
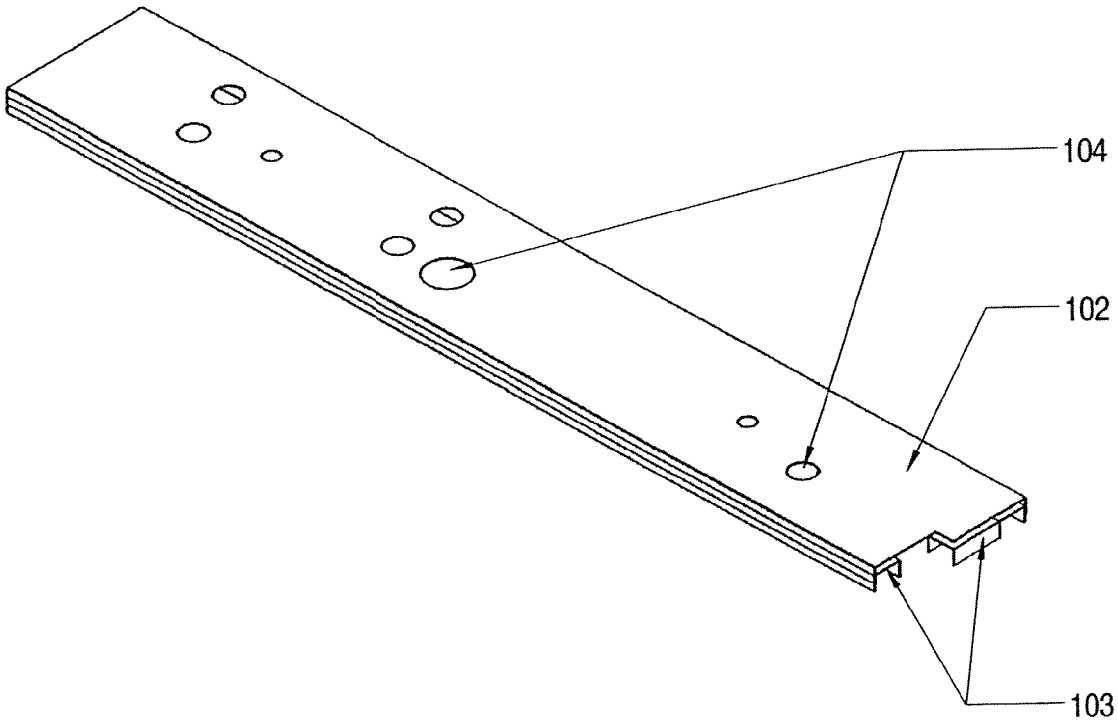
FIG. 3 illustrates the bottom and top plates, attachment of stud runners and pre-punched holes that will be used to create the non-weight bearing double stud wall.
Figure 3:
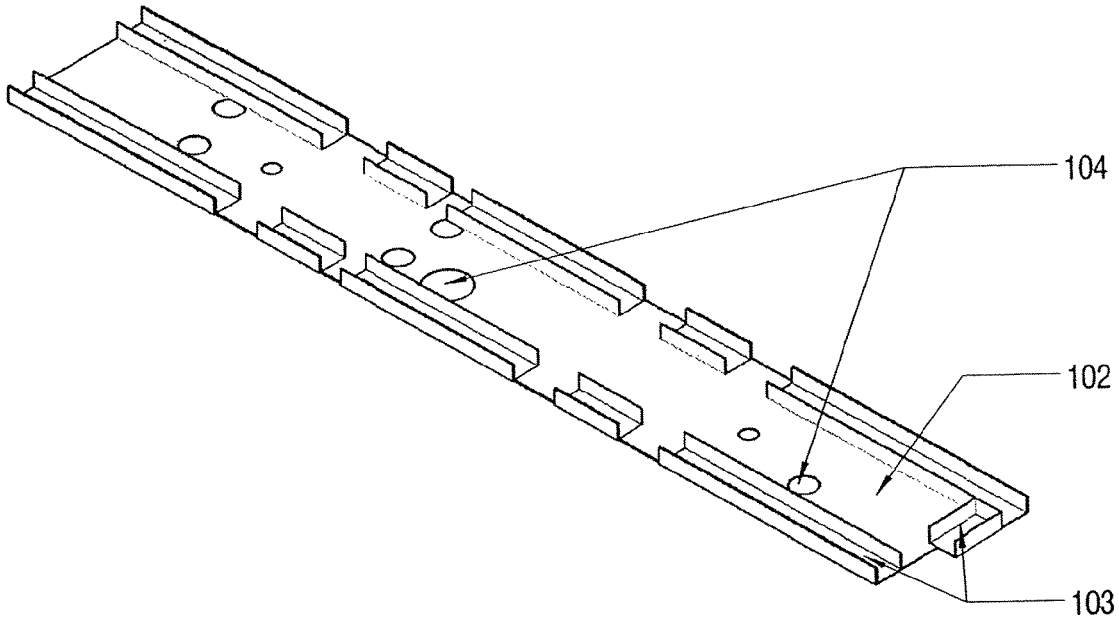
Figure 4:
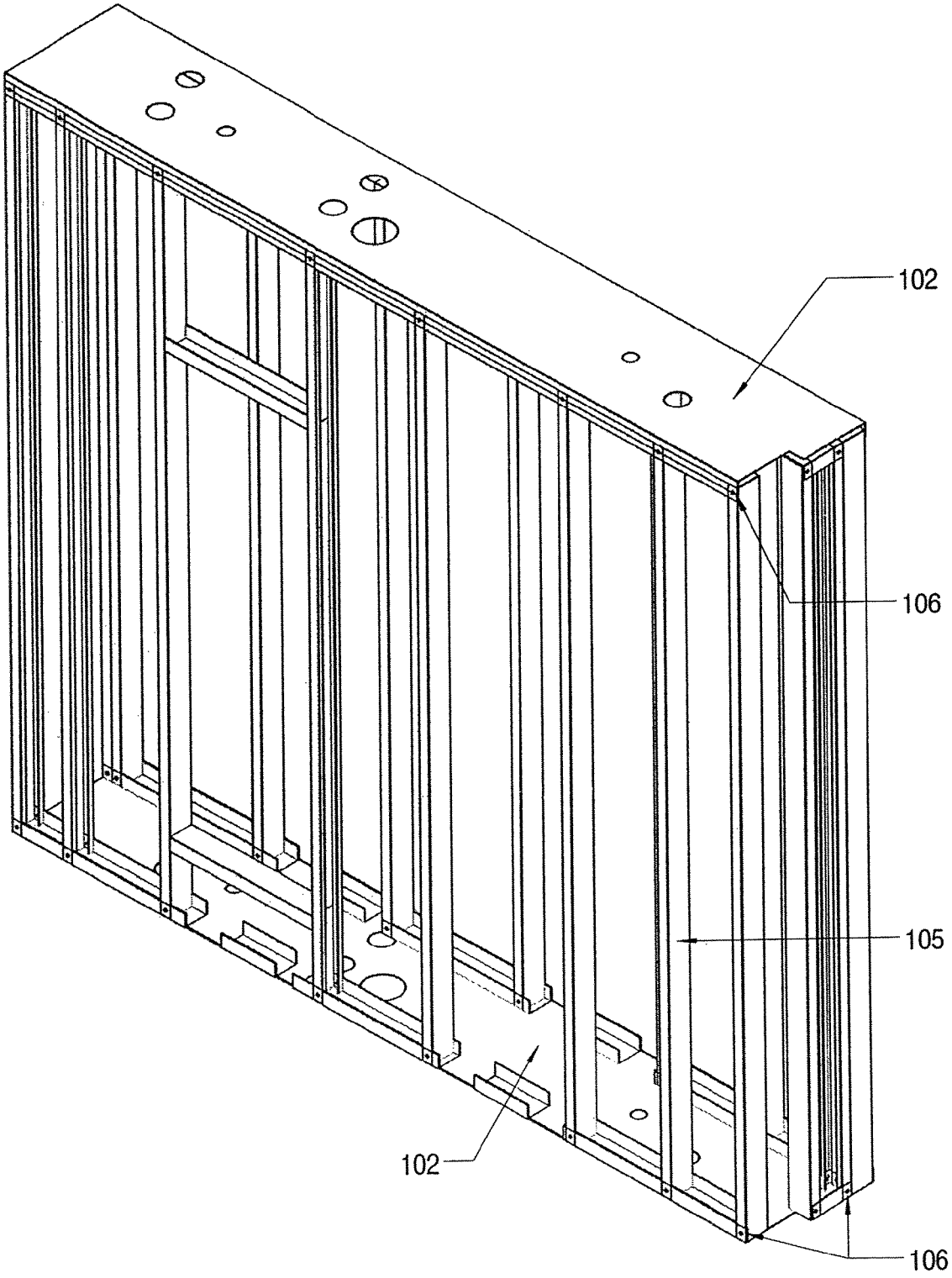
FIG. 4 illustrates metal stud placement with fasteners within the bottom and top plates creating the non-weight hearing double stud wall.
Figure 5:
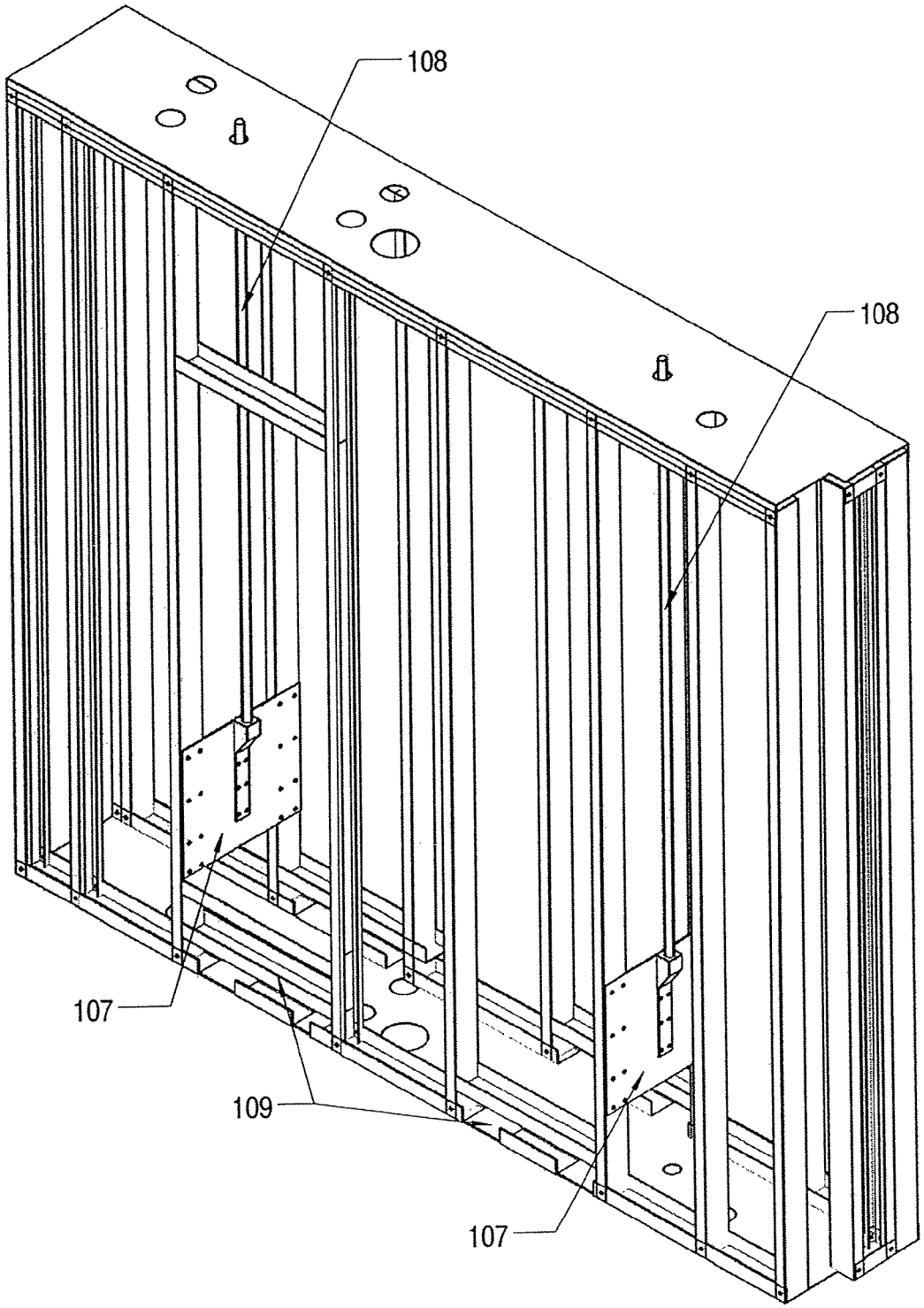
FIG. 5 illustrates the addition of reinforcement plates, lifting rods and framing pockets at the base of the wall.

FIG. 3 illustrates bottom and top plates 102 cut to predetermined lengths which will create the frame for the utility wall 101. Metal stud runners 103 are attached to the bottom and top plates 102 with appropriate fasteners. The bottom and top plates 102 are pre-punched 104 per a template that locates the exact position of penetrations for the supply and waste plumbing as well as electrical wiring and fire protection piping to run vertically through a multi-story building. This feature permits vertical stacking of the utility wall for construction of multi-story buildings. FIG. 4 illustrates the placement of the metal stud framing 105 with fasteners 106 within the bottom and top plates 102. The locations of these vertical studs are coordinated precisely with the locations of the interior components that comprise the kitchen unit, cabinets and bathroom vanity. It should be noted that the present invention does not preclude the use of varying stud sizes, gauges or spacing. Reinforcement plates 107, lifting rods 108 and framing pockets 109 are next attached to the double stud wall as shown in FIG. 5 to assist in the moving, hoisting and transportation of the utility wall 101 to the project site.

Figure 6:
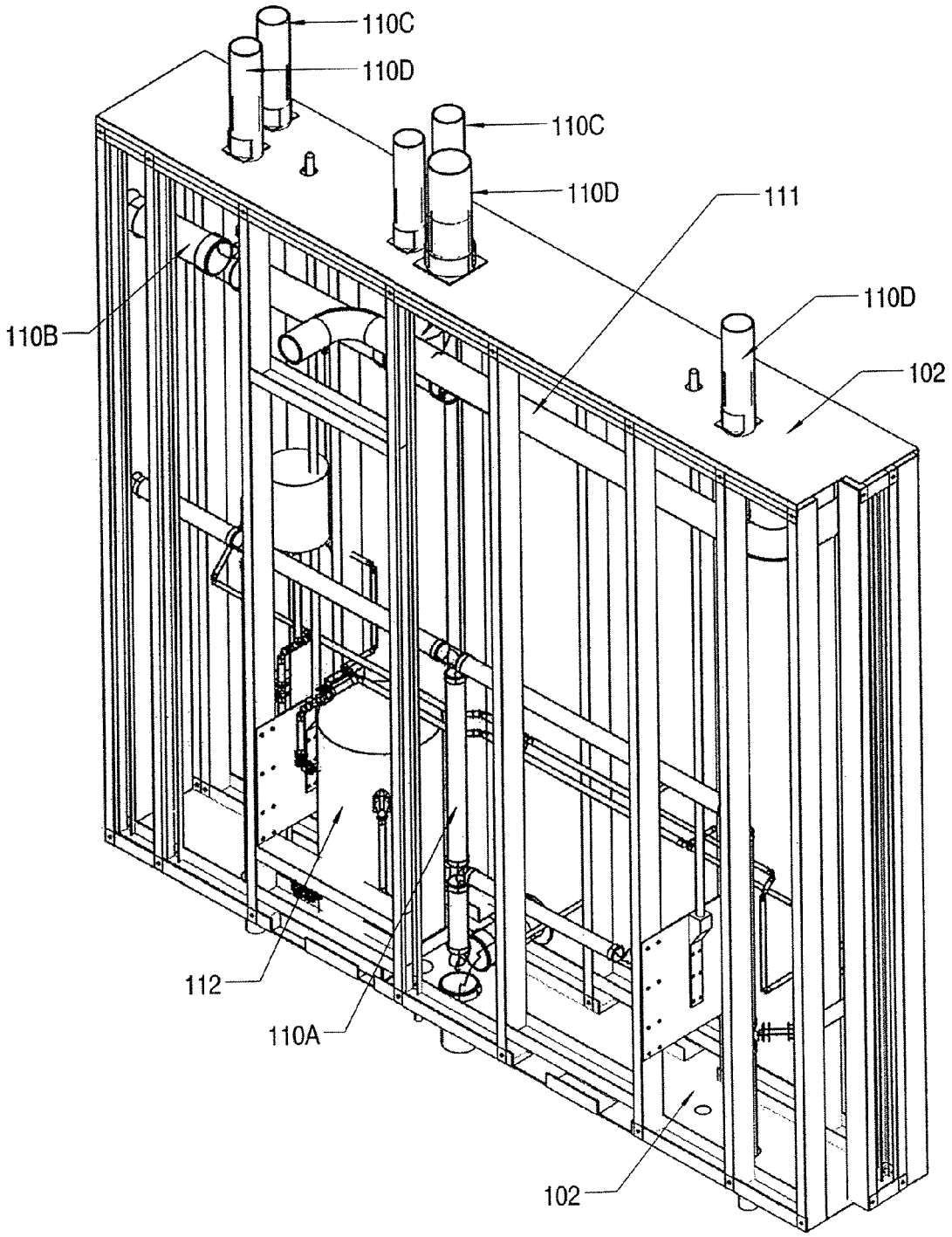
FIG. 6 illustrates the installation of supply and waste piping and vent ducting to pre-designated locations, and installation of the water heater within the wall cavity.

The next step of constructing a utility wall for the present invention involves installing the supply and waste plumbing and extending these lines vertically above the top plate 102 to connect with the utility walls 101 above in a multi-story building scenario. FIG. 6 illustrates the placement of the supply and waste plumbing 110A-B within the cavity of the utility wall 101 as determined by a specified template whereas all of the pieces have been precut to fit. Routing of vent ducting 111 also takes place at this time. The water heater 112 is located within the wall cavity and the piping is connected to it at this time. It should be noted that this invention does not preclude the elimination of the water heater within the utility wall and the introduction of central supply tank or a tankless water heater.

As shown in FIG. 6, the supply and waste lines 110C-D are sleeved beyond the top plate 102 as a means of connecting risers in a vertical orientation within a multi-story building. In an exemplary multi-story building, units are identically stacked vertically on each level of the multi-story building. The utility walls 101 are similarly identical in construction of each unit and are also stacked vertically on each level of the multi-story building. The supply and waste piping sleeves of one exemplary utility wall 101 extend through the top plate 102 enough to extend through the floor system and into the bottom plate 102 of the second exemplary utility wall 101 located on the level above of a multi-story building. In an exemplary multi-story building, units and levels are identically stacked vertically throughout the building with the exemplary utility wall 101 stacked as described above. As the utility wall 101 is placed into position, the piping extensions 110C-D penetrate through the top plate 102 and the floor system and into the bottom plate 102 of the utility wall 101 above. The utility wall 101 is subsequently anchored into position using a variety of methods available. After secure attachment of the utility wall 101 to the floor, connections are made through the lower portions of the exemplary utility wall 101 for supply and waste sleeves 110C-D. This process is repeated for as many levels as required to complete the multi-story building.

Figure 7:
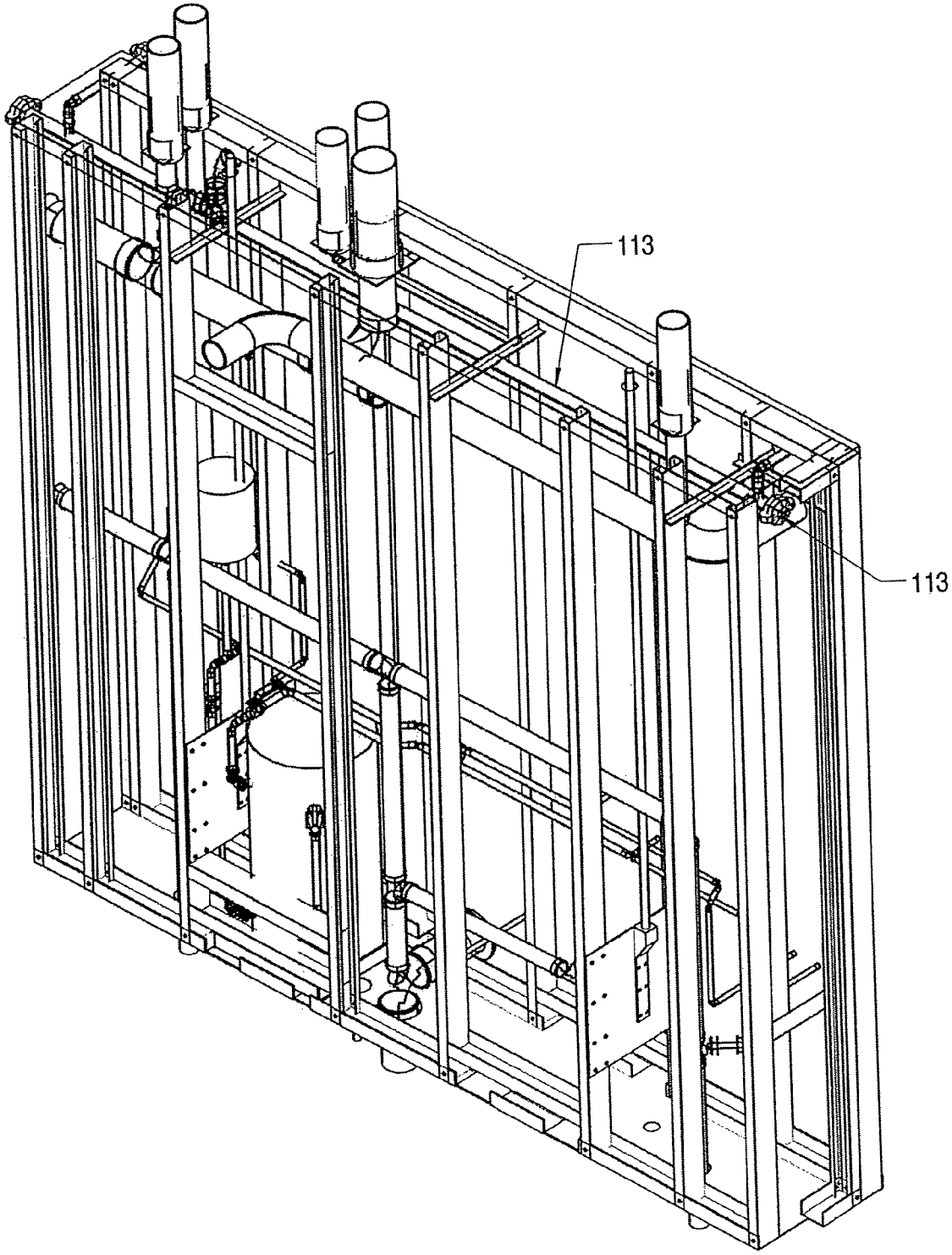
FIG. 7 illustrates the installation of the fire protection system within the double wall cavity.
Figure 8:
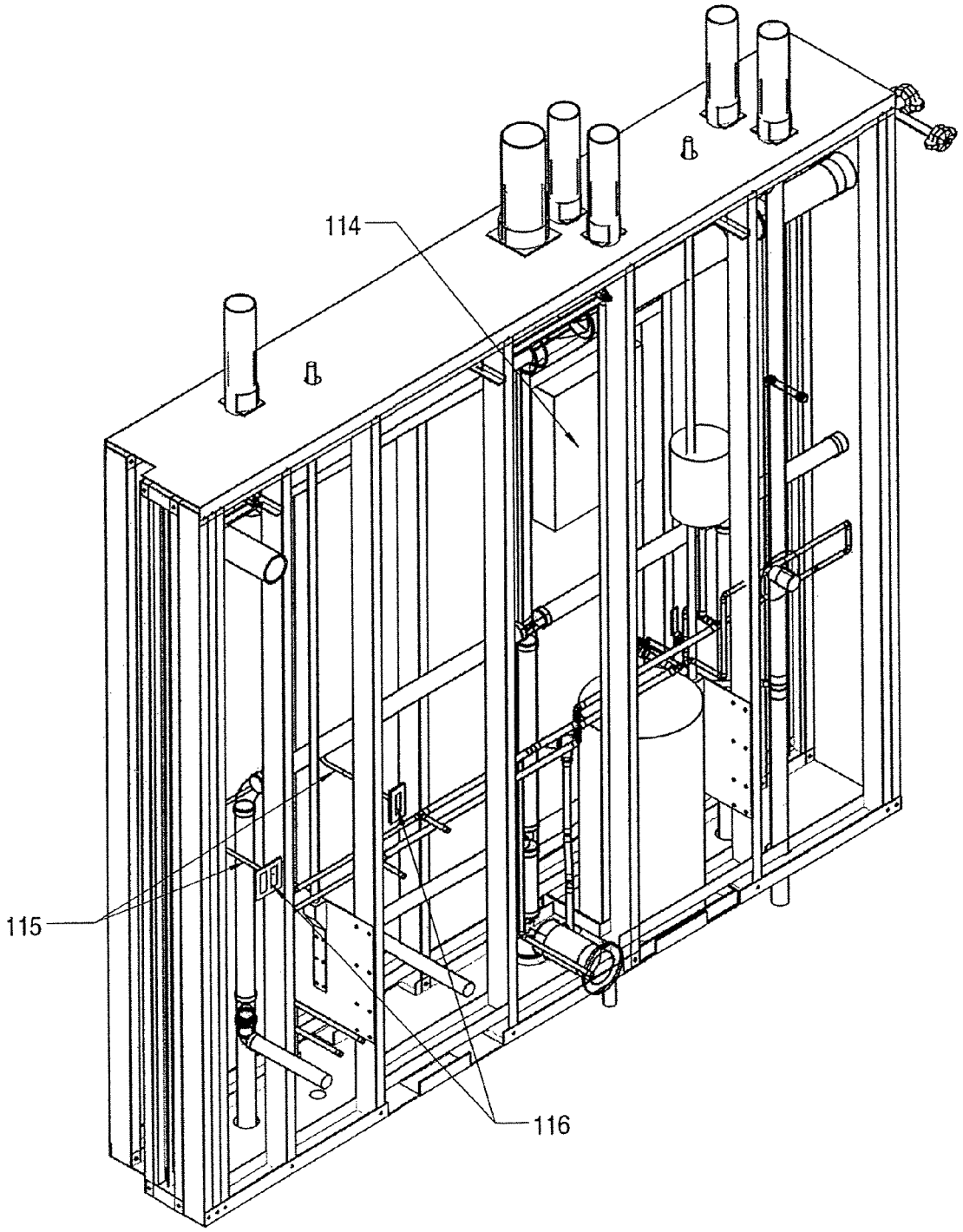
FIG. 8 illustrates the installation of the electrical panel to the outer face of the exterior stud and associated wiring and outlets.

The next step of constructing a utility wall for the present invention involves installing the fire protection piping and electrical wiring as shown in FIGS. 7-8. Illustrated in FIG. 7 is the placement of the fire protection system 113 within the cavity of the utility wall 101. FIG. 8 illustrates the installation of the electrical panel 114 to the outer face of the exterior stud of the utility wall 101, and the running of electrical wiring 115 and outlets 116 within the utility wall 101 to prescribed locations.

Figure 9:
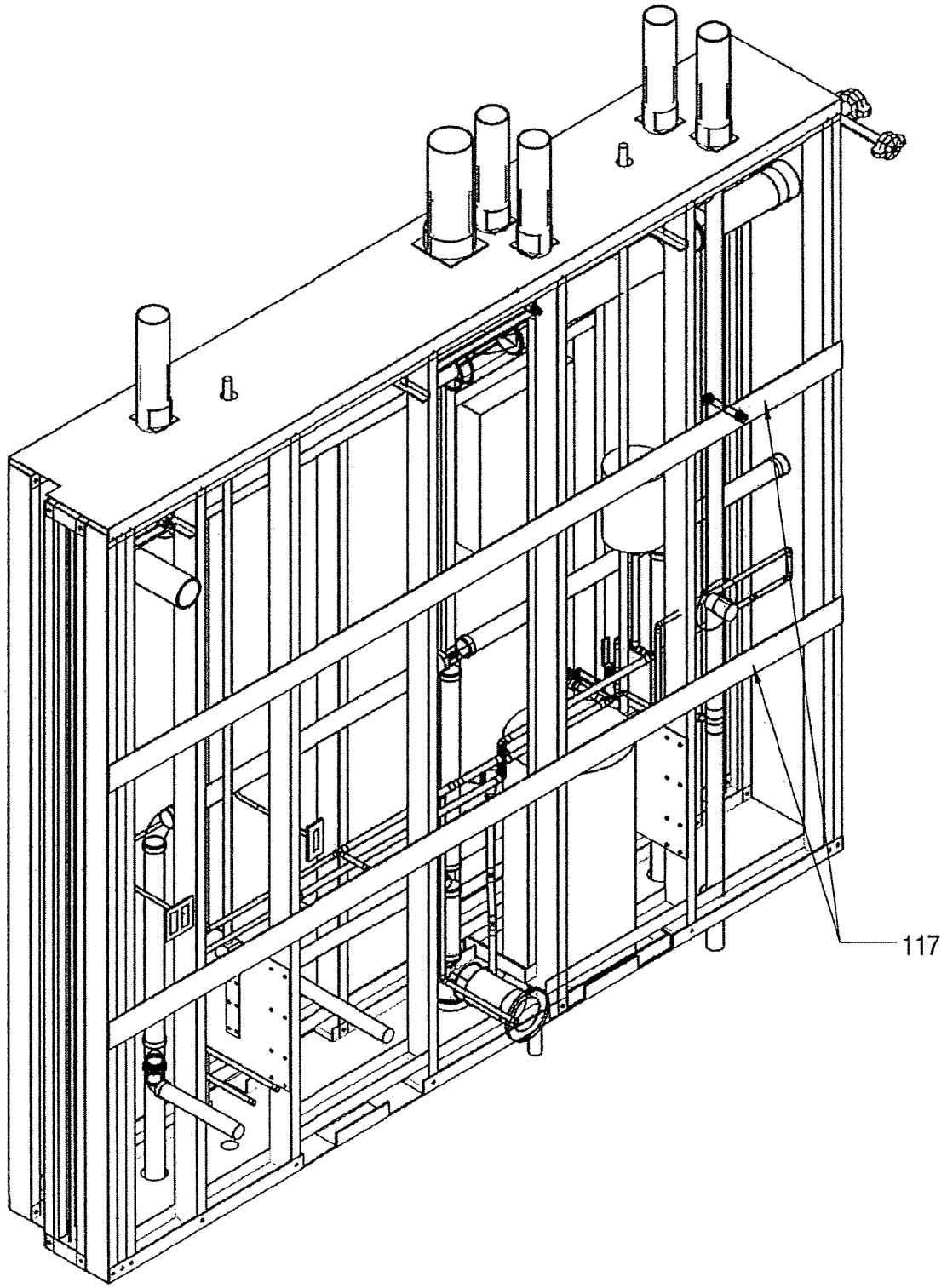
FIG. 9 illustrates the installation of blocking to the face of the interior stud.
Figure 10:
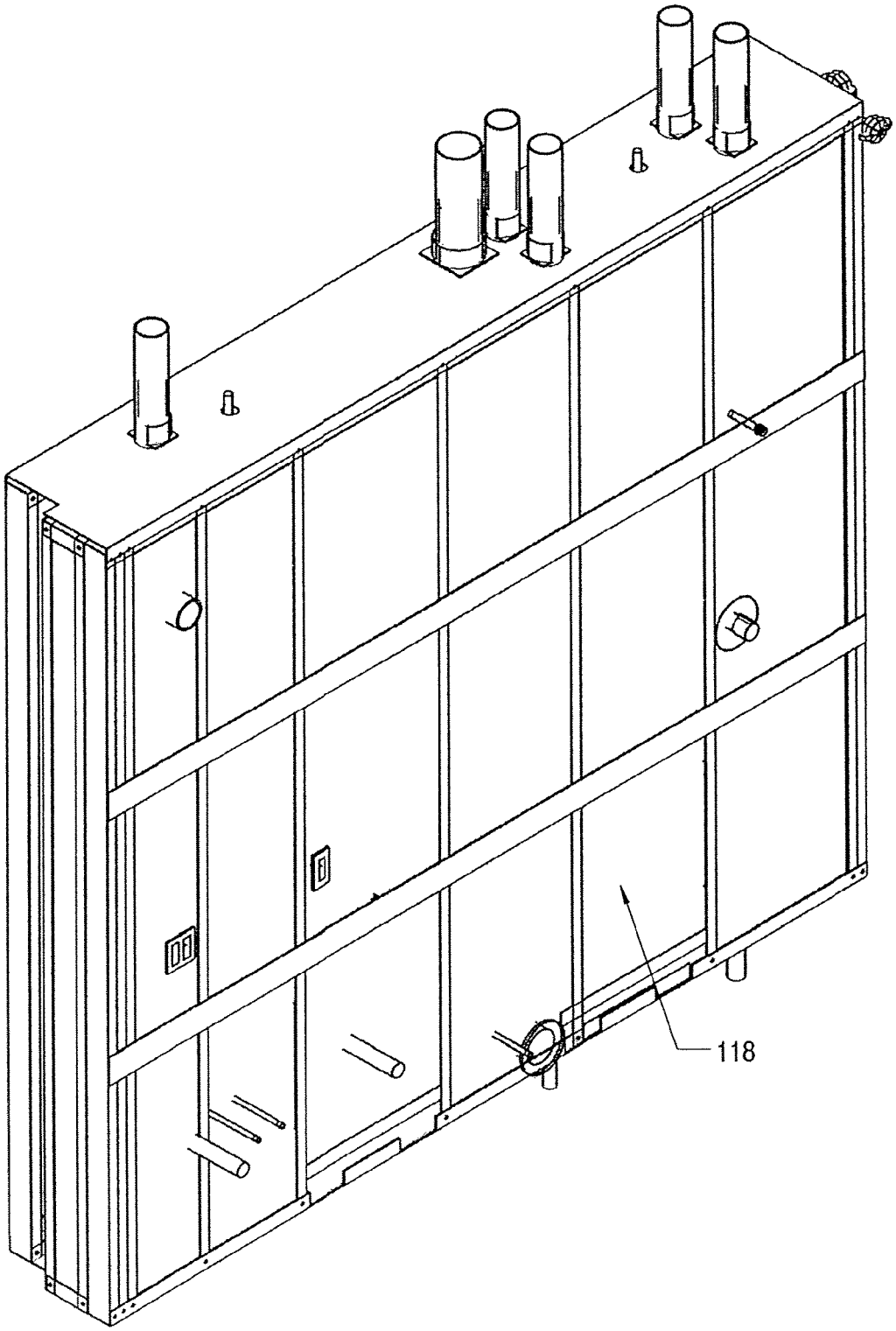
FIG. 10 illustrates the installation of acoustical blanket insulation within the interior metal stud wall.
Figure 11:
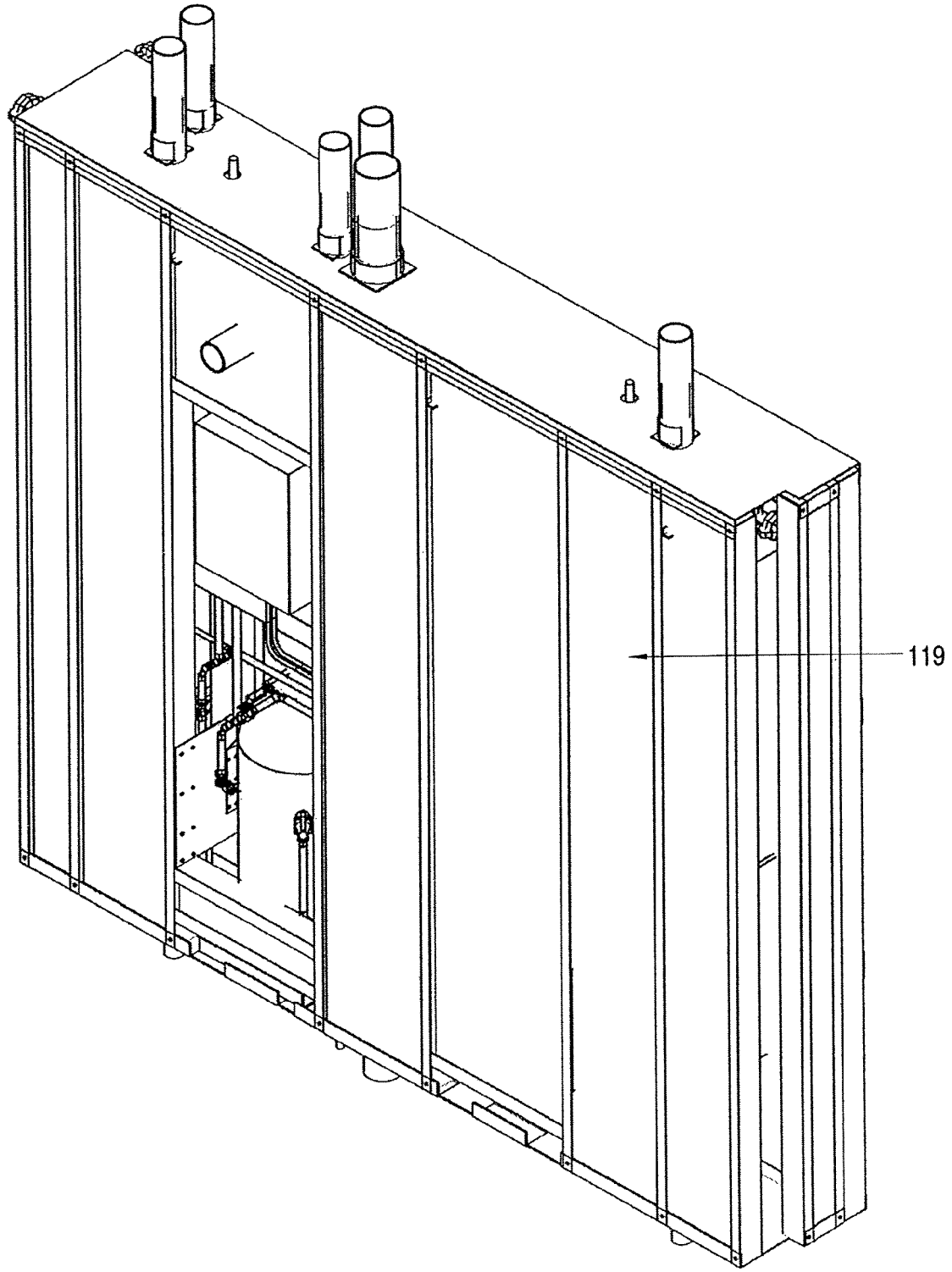
FIG. 11 illustrates the installation of the thermal batt insulation within the exterior metal stud wall.

As shown in FIG. 9, blocking 117 is attached on the interior face of the interior stud on utility wall 101. The precut pieces are attached using standard screws at prescribed locations to be utilized as support for the interior fixtures, kitchen counters and kitchen cabinets. It should be noted that wood or metal blocking can be used in the present invention. FIG. 10 illustrates the installation of the acoustic blanket insulation 118 within the stud framing of the interior wall while FIG. 11 illustrates the installation of the thermal batt insulation 119 within the stud framing of the exterior wall.

Figure 12:
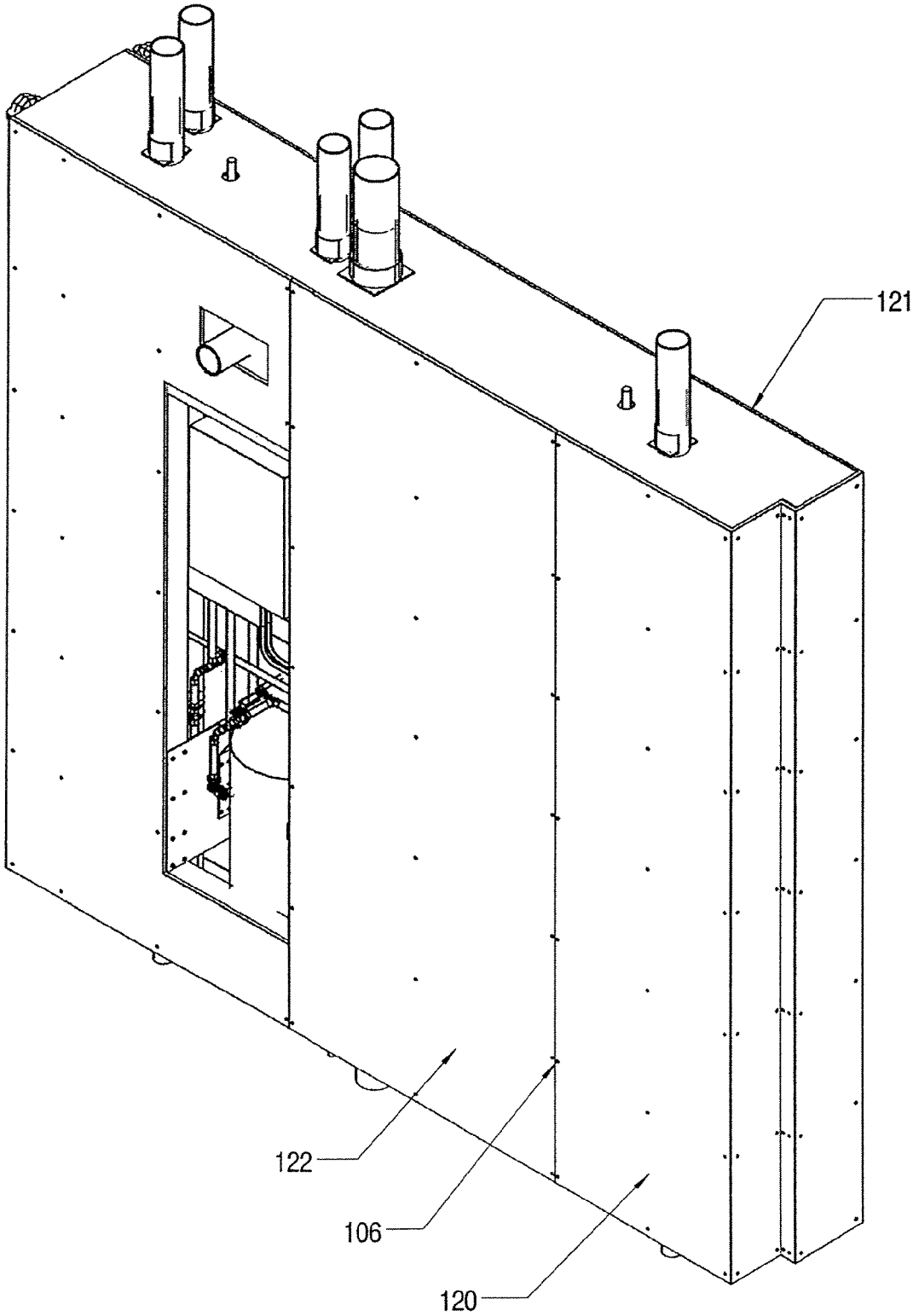
FIG. 12 illustrates the attachment of one layer of sheathing board and applied to the exterior and interior faces with fasteners and the application of the weather resistive barrier applied to the exterior face.
Figure 13:
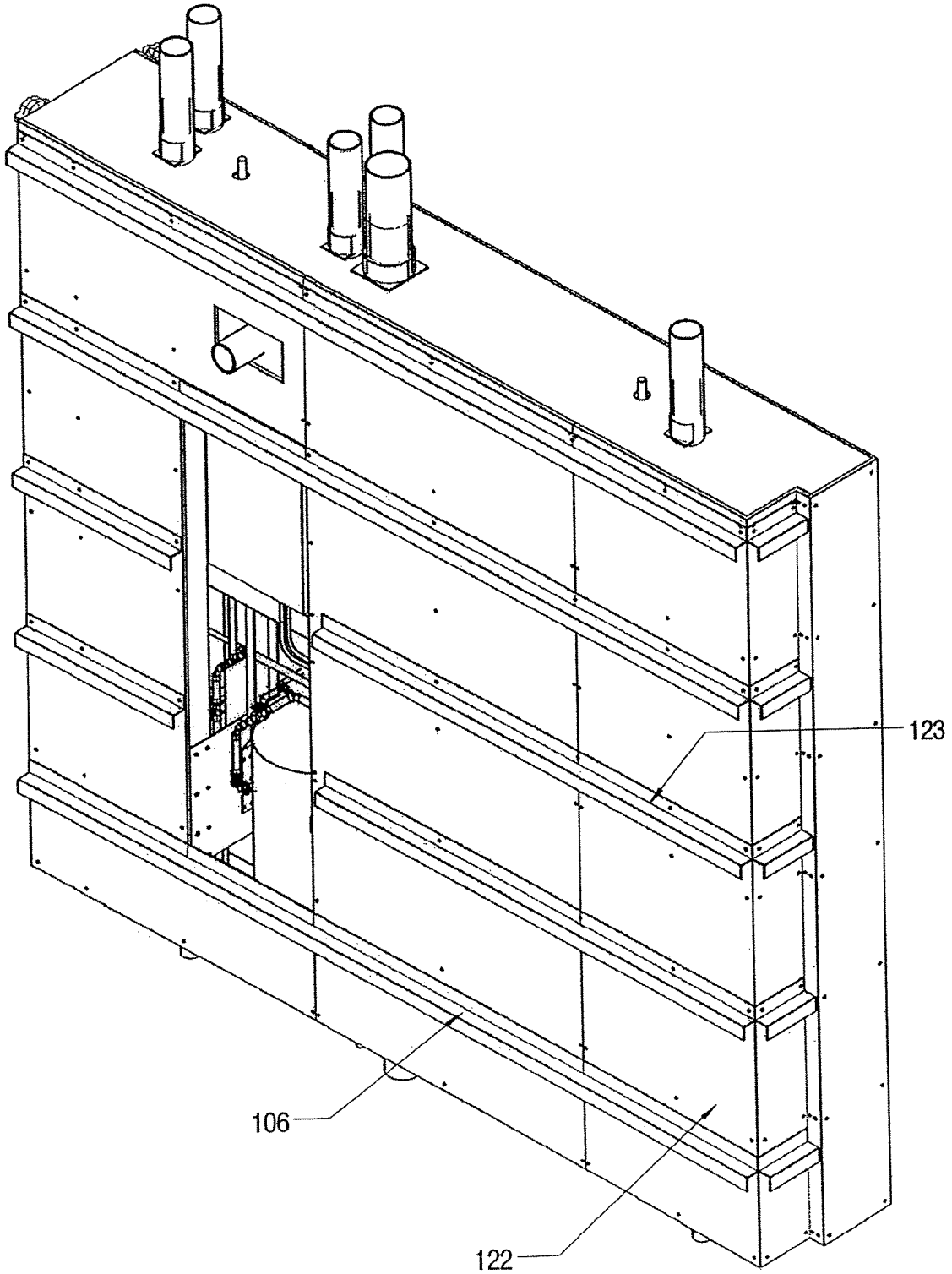
FIG. 13 illustrates the installation of horizontal furring on the exterior face of the exterior sheathing board with fasteners.
Figure 14:
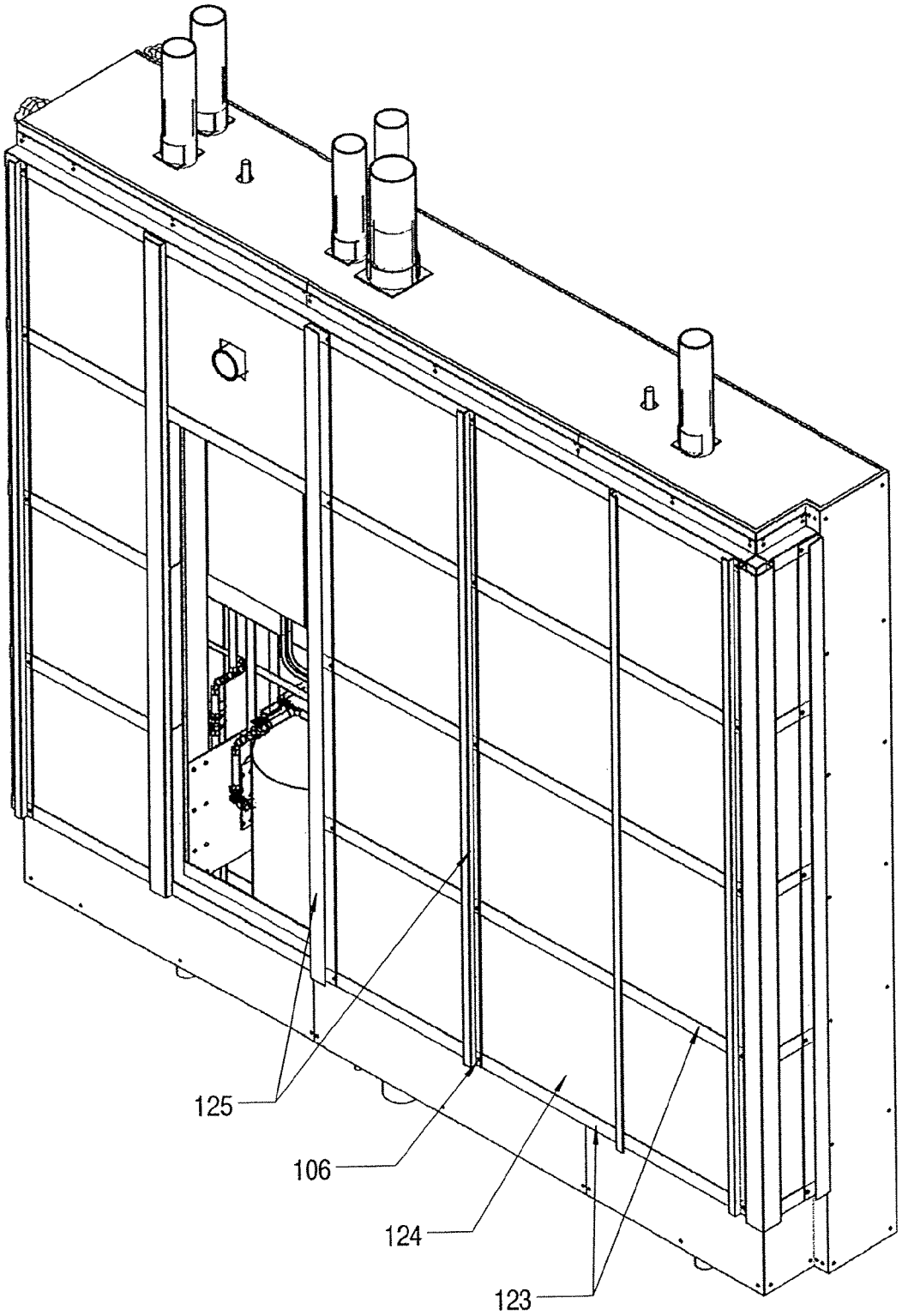
FIG. 14 illustrates the installation of rigid insulation between the horizontal furring and the attachment of vertical furring channels to the horizontal furring with fasteners.
Figure 15:
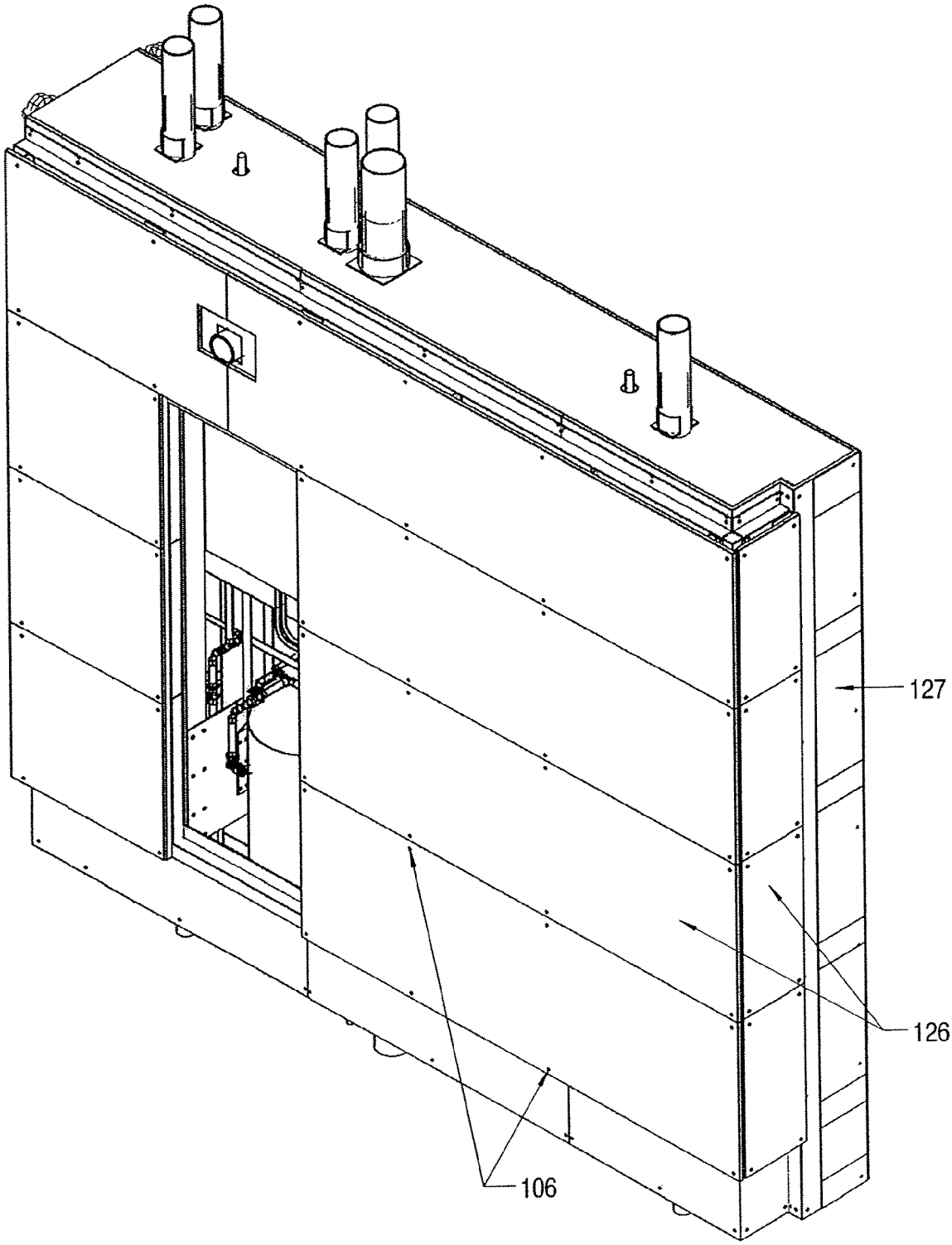
FIG. 15 illustrates the application of the finished exterior and interior panels.
Figure 16:
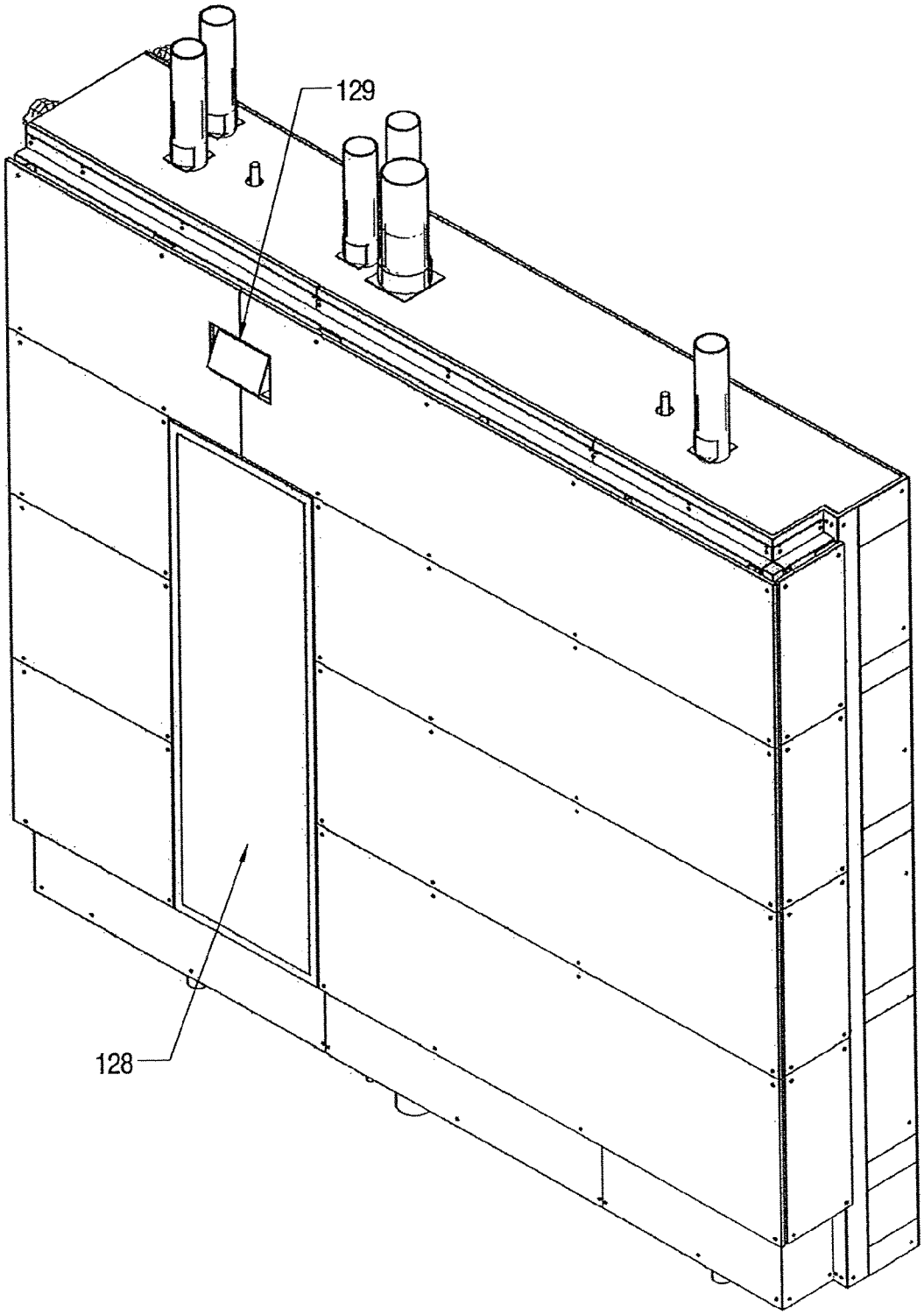
FIG. 16 illustrates the installation of the access panel/door, associated gaskets and flashings and the vent hood and trim.

The pre-fabrication of utility wall 101 is completed as illustrated by FIGS. 12-16. An exterior and interior sheathing board 120, 121 is attached over the insulation to the face of the exterior and interior stud walls with manufacturer recommended fasteners 106 as illustrated in FIG. 12. The sheathing 120, 121 is preferably a 12 mm magnesium oxide board, however, other types of fire rated wall panels with safety mechanisms may be used and this example is not meant to be limiting. These boards are precut to size and attached according to a predetermined template to exploit efficiencies in board use. A weather resistant barrier 122 is applied to the exterior face of the exterior sheathing board 120 and integrated into the access panel cavity to provide a weather-tight assembly. The next step as illustrated in FIG. 13 is to attach horizontal furring 123 over the weather resistive barrier 122 with the appropriate fasteners 106. FIG. 14 illustrates the attachment of the rigid insulation 124 between the horizontal furring 123 followed by the attachment of vertical furring channels 125 to the horizontal furring 123 with fasteners 106. As illustrated in FIG. 15, the exterior cladding 126 is attached to the vertical furring channels 125 with appropriate fasteners 106, while the interior finish 127 is applied to the interior sheathing board 121 on the interior of the utility wall 101. The final step, as shown in FIG. 16, is to attach access panel 128 and vent hood 129 and associated trim to complete the utility wall 101. It should be noted that various exterior and interior finish materials can be utilized in the present invention. In as such, attachment of these varying materials may change the steps as outlined above in the attachment of the cladding materials to the base utility wall.

In one example, the utility wall is delivered to a building site as a pre-manufactured, pre-plumbed, pre-wired, prefinished, preassembled and pre-bundled component. Possible cladding materials that may be used for the rain screen panels include, but are not limited to, phenolic resin board, metal panel, cementitious board, wood siding, gypsum reinforced fiber cement panel, precast concrete panel and ceramic tile. The utility wall may be an all-encompassing finished unit on both the interior and exterior sides.

This invention does not preclude the elimination of one or more parts of this utility wall to achieve a more efficient installation method in the field. For example, the utility wall 101 could arrive on site without the horizontal furring 123, rigid insulation 124, vertical furring 125, exterior cladding 126, interior finish material 127, and access panel 128 and vent hood 129.

The utility wall 101 is composed of metal stud framing 105, an integrated acoustical blanket insulation layer 118 within the interior stud of the utility wall 101, an interior sheathing board 121 and an interior finish material 127. The utility wall 101 arrives on site with all of the plumbing 110A-D and necessary blocking 117 associated with the kitchen sink, counters, cabinets, toilet, and shower already in place. The utility wall 101 also includes the shower valves, shower head, and associated trim. The utility wall 101 further contains the unit's electrical panel 114 and water heater 112 behind an accessible panel 128. The exterior side of the utility wall 101 is composed metal stud framing 105, an integrated thermal batt insulation layer 119 within the exterior stud of the utility wall 101, fire-rated exterior sheathing board 120, a weather resistive barrier 122, horizontal furring 123, rigid insulation 124, vertical furring channels 125, exterior cladding 126, an access panel 128, and vent hood and trim 129.

All of the unit's utility connections occur at the utility wall 101. The electrical and communications main lines run in the utility wall 101. At each unit, the electrical service feeds directly into the utility wall's 101 electrical panel 114. Wiring connections to other wall components occur via preinstalled wiring. Electrical and communications connections are carried out at the time of installation of each adjacent utility wall 101. The utility wall 101 has vents 129 located respectively in the bathroom and kitchen on top portions of utility wall 101. The utility wall 101 also has plumbing 110A-B for supply and waste for connecting the bathroom vanity and sink with a sink and kitchen unit. There is a plurality of outlets 116 located in the utility wall 101 for the bathroom and kitchen. The utility wall 101 that arrives on site also has a pre-integrated shower head and shower valves.

It should also be noted that relative terms are meant to help in the understanding of the structures and are not meant to limit the scope of the invention. Similarly, the term "head" is meant to be relative to the term "base," and the term "top" is meant to be relative to the term "bottom." It should further be noted that the term "right" is meant to be relative to the term "left," and the term "horizontal" is meant to be relative to the term "vertical". It should be further noted that although the present invention is described using certain structures such as fasteners, however, any other types of means can be used to attach the walls.

The terms and expressions that have been employed in the foregoing specification are used as terms of description and not of limitation, and are not intended to exclude equivalents of the features shown and described. This application is intended to cover any adaptations or variations of the present invention. It will be appreciated by those of ordinary skill in the art that any arrangement that is calculated to achieve the same purpose may be substituted for the specific embodiment shown. It is also to be understood that the following claims are intended to cover all of the generic and specific features of the invention herein described and all statements of the scope of the invention which, as a matter of language, might be said to fall there between.

What is claimed is:

1. A pre-manufactured utility wall comprising:

an interior-facing surface, the interior-facing surface including an interior finish material and an interior sheathing board behind the interior finish material;

an exterior-facing surface, the exterior-facing surface including an exterior cladding and a rigid insulation behind the exterior cladding, wherein the exterior-facing surface is configured to be an exterior surface of a building;

a non-weight bearing double stud wall, the non-weight bearing double stud wall including interior studs and exterior studs;

an acoustical blanket insulation layer between the interior studs;

a thermal batt insulation layer between the exterior studs;

an electrical panel and electrical wiring;

a wall cavity; and supply and waste plumbing;

wherein the non-weight bearing double stud wall, the wall cavity, and the supply and waste plumbing are located between the interior-facing surface and the exterior-facing surface.

2. The utility wall of claim 1, wherein the exterior facing surface further comprises a weather resistive barrier behind the rigid insulation.

3. The utility wall of claim 2, wherein the exterior facing surface further comprises a fire-rated exterior sheathing board behind the weather resistive barrier.

4. The utility wall of claim 1, further comprising an access panel located on the exterior facing surface.

5. The utility wall of claim 4, wherein the electrical panel is installed on an outer face of an exterior stud of the non-weight bearing double stud wall and is located behind the access panel.

6. The utility wall of claim 1, further comprising electrical wiring for adjacent walls and outlets.

7. The utility wall of claim 1, further comprising fire protection piping.

8. The utility wall of claim 7, further comprising at least one of the supply and waste plumbing, the electrical wiring, and the fire protection piping running in a vertical orientation.

9. The utility wall of claim 8, wherein at least one of the supply and waste plumbing, the electrical wiring, and the fire protection piping vertically extends out of the utility wall and towards a second vertically stacked utility wall.

10. The utility wall of claim 9, further comprising a top plate and a bottom plate, wherein the top plate and the bottom plate each include at least one opening.

11. The utility wall of claim 10, wherein the at least one opening in each of the top plate and the bottom plate permit extension of at least one of the supply and waste plumbing, the electrical wiring, and the fire protection piping vertically extending from an interior of the utility wall towards the second vertically stacked utility wall.

12. The utility wall of claim 10, further comprising a first plurality of stud runners along a perimeter of the top plate and a second plurality of stud runners along a perimeter of the bottom plate, wherein the first and second plurality of stud runners are configured to couple the interior studs and the exterior studs to the top and bottom plates.

13. The utility wall of claim 11, wherein the vertical extension of at least one of the supply and waste plumbing, the electrical wiring, and the fire protection piping from the interior of the utility wall towards the second vertically stacked utility wall is of sufficient length to additionally penetrate and vertically extend through a separate floor system located between the utility wall and the second vertically stacked utility wall.

14. The utility wall of claim 1, further comprising at least one of vent ducting, a water heater, metal stud framing, an integrated acoustical blanket insulation layer, a reinforcement plate, a lifting rod, a framing pocket, and blocking support associated with on-site attachment of interior fixtures.

15. A pre-manufactured stackable utility wall system for vertical connection of utilities between multiple building levels, wherein each utility wall comprises:

an interior-facing surface, the interior-facing surface including an interior finish material and an interior sheathing board behind the interior finish material;

an exterior-facing surface, the exterior-facing surface including an exterior cladding and a rigid insulation behind the exterior cladding, wherein the exterior-facing surface is configured to be an exterior surface of a building;

a double stud wall, the double stud wall including interior studs and exterior studs;

an acoustical blanket insulation layer between the interior studs;

a thermal batt insulation layer between the exterior studs;

a wall cavity;

an electrical panel and vertical electrical wiring;

vertical supply and waste plumbing;

a top plate and a bottom plate, wherein the top plate and the bottom plate each include at least one opening; and wherein the double stud wall, the wall cavity, the vertical supply and waste plumbing are located between the interior-facing surface and the exterior-facing surface, and wherein the vertical supply and waste plumbing extends through the at least one opening in at least one of the top plate and the bottom plate to a vertically adjacent utility wall.

16. The pre-manufactured stackable utility wall system of claim 15, further comprising a floor system that provides passage to the vertical supply and waste plumbing.

17. The pre-manufactured stackable utility wall system of claim 16, wherein each utility wall is securely attached to a floor of the floor system.

18. The pre-manufactured stackable utility wall system of claim 16, wherein the vertical supply and waste plumbing of a first utility wall and a second utility wall connects via piping extensions that penetrate the floor system.

19. The utility wall of claim 15, further comprising a first plurality of stud runners along a perimeter of the top plate and a second plurality of stud runners along a perimeter of the bottom plate, wherein the first and second plurality of stud runners are configured to couple the interior studs and the exterior studs to the top and bottom plates.

* * * * *

UNITED STATES PATENT AND TRADEMARK OFFICE

CERTIFICATE OF CORRECTION

PATENT NO. : 8,978,324 B2
APPLICATION NO. : 14/077565
DATED : March 17, 2015
INVENTOR(S) : Collins et al.

It is certified that error appears in the above-identified patent and that said Letters Patent is hereby corrected as shown below:

On the title page item (72), under "Inventors", in Column 1, Lines 1-2, delete "Mark Woerman," and insert -- Mark L. Woerman, --, therefor.

In the Specification

In Column 1, Line 5, delete "continuation" and insert -- continuation under 35 U.S.C. §120 --, therefor.

In Column 3, Line 14, delete "hearing" and insert -- bearing --, therefor.

In the Claims

In Column 7, Line 29, in Claim 1, delete "exterior" and insert -- interior --, therefor.

In Column 9, Line 1, in Claim 19, delete "The utility" and insert -- The pre-manufactured stackable utility --, therefor.

Signed and Sealed this
Eleventh Day of August, 2015

Michelle K. Lee

Michelle K. Lee
*Director of the United States Patent and Trademark Office*